US005590775A

United States Patent [19]

Moore

[11] Patent Number: 5,590,775

[45] Date of Patent: Jan. 7, 1997

[54] CHRISTMAS TREE TRANSPORT AND STORAGE SATCHEL

[76] Inventor: Carter Moore, 101 Terrace Ave., Apt. 1K, Hasbrouck Heights, N.J. 07604

[21] Appl. No.: 502,474

[22] Filed: Jul. 14, 1995

[51] Int. Cl.[6] ..... B65D 85/52

[52] U.S. Cl. ..... 206/423; 47/84; 294/150

[58] Field of Search ..... 47/84; 150/154; 206/423; 229/87.04; 294/150; 428/15

[56] References Cited

U.S. PATENT DOCUMENTS

| | | | |
|---|---|---|---|
| 2,781,811 | 2/1957 | Dilar et al. | 206/423 |
| 3,439,865 | 4/1969 | Port et al. | 383/117 |
| 4,054,166 | 10/1977 | Burke | 206/423 |
| 4,384,604 | 5/1983 | DeLaura et al. | 206/423 |
| 4,799,520 | 1/1989 | Blackburn et al. | 206/423 |
| 4,969,555 | 11/1990 | Fitzgerald | 206/423 |
| 5,359,810 | 11/1994 | Aul | 47/84 |

FOREIGN PATENT DOCUMENTS

| | | | |
|---|---|---|---|
| 331129 | 6/1930 | United Kingdom | 150/154 |

*Primary Examiner*—Jimmy G. Foster

[57] ABSTRACT

A Christmas tree storage and transport satchel adapted for use in association with a Christmas tree, the apparatus comprising: a tarp formed in a generally elliptical configuration with two end edges and a rounded central region therebetween, the tarp having an inner surface and an outer surface, each end edge including a plurality of grommets extending therealong, the tarp having a first side edge and a second side edge each including coupling devices, the outer surface of the tarp including a hand strap affixed thereto, in an operative orientation the tarp being wrapped around a Christmas tree with the coupling devices of each side edge being coupled together, a drawstring being positioned through the grommets of each end edge to enable users to close the edges by tightening the drawstrings so that debris from the Christmas tree does not escape from the apparatus.

1 Claim, 3 Drawing Sheets

FIG 1
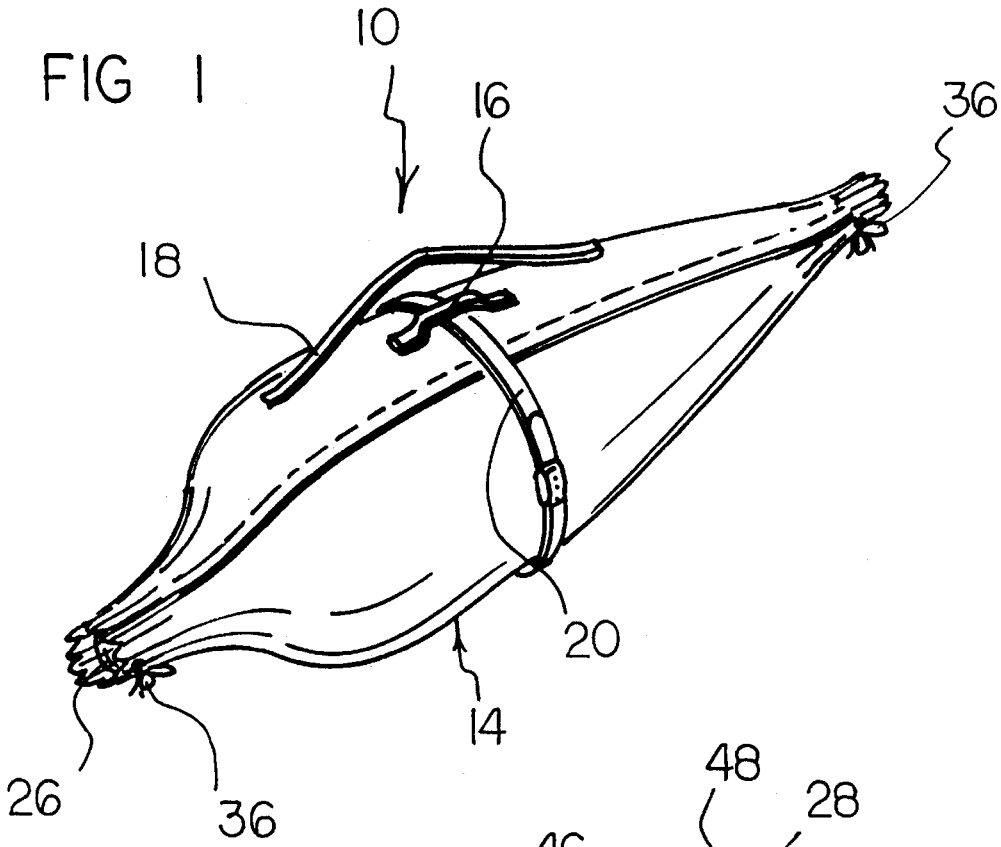
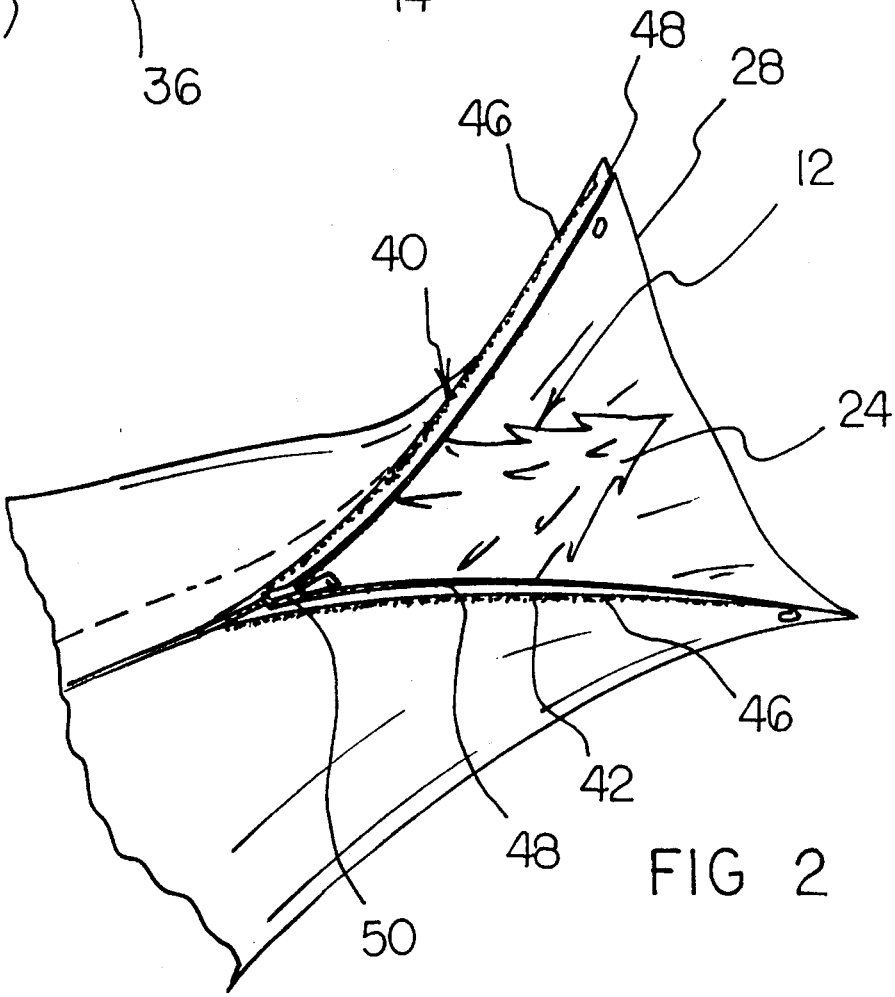
FIG 2

FIG 5
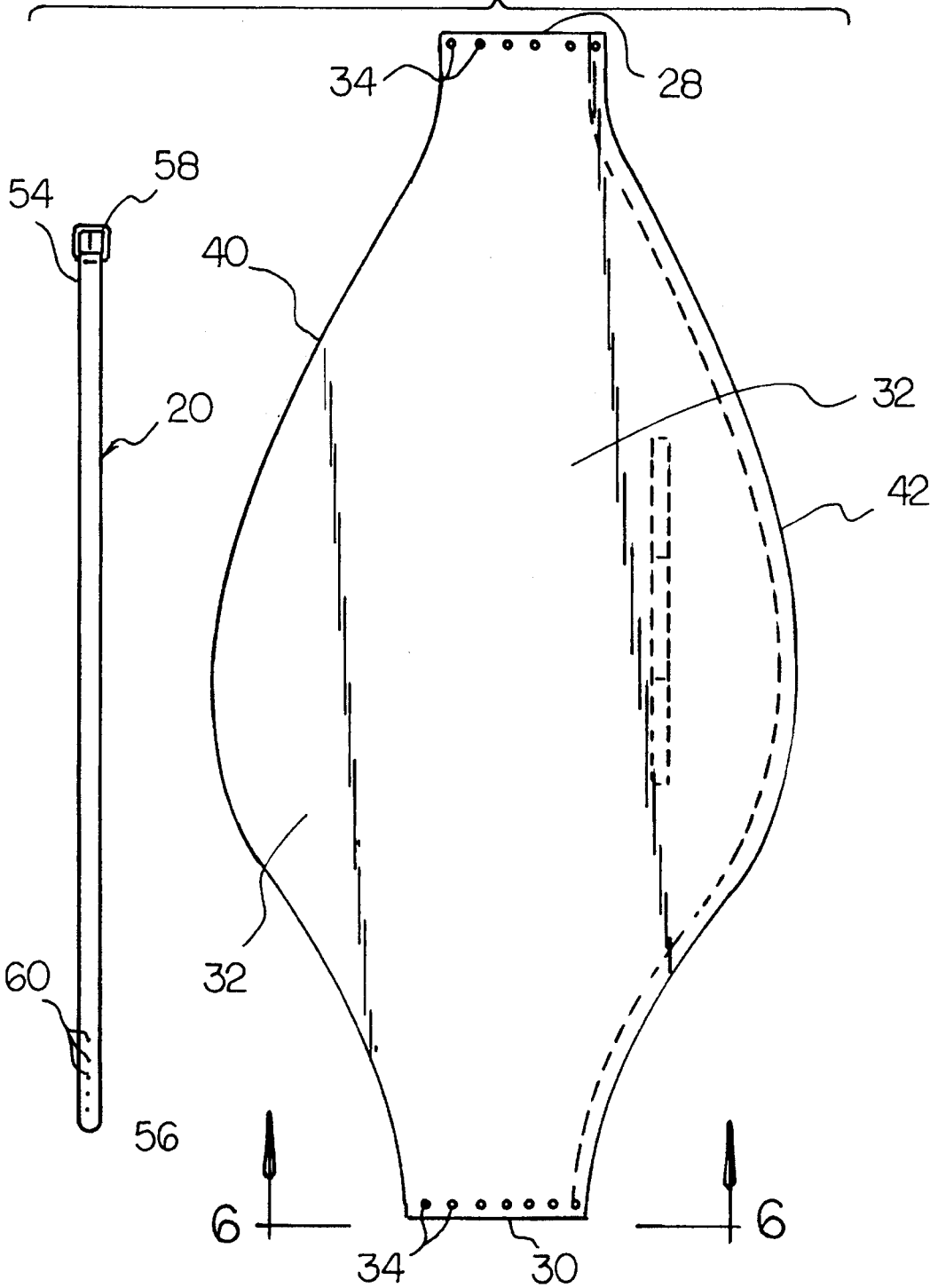
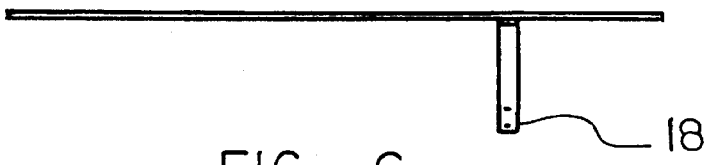
FIG 6

CHRISTMAS TREE TRANSPORT AND STORAGE SATCHEL

BACKGROUND OF THE INVENTION

1. Field of the Invention

The present invention relates to a Christmas tree transport and storage satchel and more particularly pertains to placing the apparatus around a Christmas tree to aid users in transporting and storing the tree.

2. Description of the Prior Art

The use of Christmas tree bags is known in the prior art. More specifically, Christmas tree bags heretofore devised and utilized for the purpose of covering Christmas trees are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,054,166 to Burke a Christmas tree cover.

U.S. Pat. No. 5,291,999 to Phair discloses a Christmas tree bag.

U.S. Pat. No. Des. 349,469 to Mitchell discloses an adjustable Christmas tree carrier.

U.S. Pat. No. 4,799,520 to Blackburn discloses a cover for Christmas trees.

U.S. Pat. No. 4,899,878 to Lofton discloses a Christmas tree disposal bag.

Lastly, U.S. Pat. No. 3,872,906 to Bolanz discloses a Christmas tree cover.

In this respect, the Christmas tree transport and storage satchel according to the present invention substantially departs from the conventional concepts and designs of the prior art, and in doing so provides an apparatus primarily developed for the purpose of placing the apparatus around a Christmas tree to aid users in transporting and storing the tree.

Therefore, it can be appreciated that there exists a continuing need for a new and improved Christmas tree transport and storage satchel which can be used for placing the apparatus around a Christmas tree to aid users in transporting and storing the tree. In this regard, the present invention substantially fulfills this need.

SUMMARY OF THE INVENTION

In view of the foregoing disadvantages inherent in the known types of Christmas tree bags now present in the prior art, the present invention provides an improved Christmas tree transport and storage satchel. As such, the general purpose of the present invention, which will be described subsequently in greater detail, is to provide a new and improved Christmas tree transport and storage satchel and method which has all the advantages of the prior art and none of the disadvantages.

To attain this, the present invention essentially comprises a new and improved Christmas tree transport and storage satchel comprising, in combination: a Christmas tree formed in a generally conical configuration and including an upper extent having a point and a lower extent having a stump; a tarp fabricated of heavy duty nylon and formed in a generally elliptical configuration with two linear end edges and a rounded central region therebetween, the tarp having an inner surface and an outer surface, each linear end edge including a plurality of grommets extending therealong, the tarp having a first side edge and a second side edge, each side edge extending along the entire length of the tarp, each side edge including VELCRO coupling devices and zipper teeth, the first side edge adapted to be coupled on top of the second side edge whereby the first side edge forms a flap, the zipper teeth of the side edges adapted to be coupled together by a slidable zipper coupler, the outer surface of the tarp including a centrally positioned hand strap affixed thereto in an orientation perpendicular to the end edges, a shoulder strap being coupled adjacent to the hand strap in an orientation parallel to the hand strap, the shoulder strap being large enough to permit users to position an arm or shoulder therethrough, in an operative orientation the tarp being wrapped around a Christmas tree with the respective zipper teeth and VELCRO coupling devices being coupled together, a drawstring being positioned through the grommets of each end edge to enable users to close the ends by tightening the drawstrings so that debris from the Christmas tree does not escape from the apparatus; and an adjustable belt formed in an elongated configuration with a first end and a second end, the first end including a buckle coupling device, the second end including a plurality of holes positioned along its length, in an operative orientation the user adjusting the belt around the approximate centerpoint of the tarp to stabilize an enclosed Christmas tree.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved Christmas tree transport and storage satchel which has all of the advantages of the prior art Christmas tree bags and none of the disadvantages.

It is another object of the present invention to provide a new and improved Christmas tree transport and storage satchel which may be easily and efficiently manufactured and marketed.

It is further object of the present invention to provide a new and improved Christmas tree transport and storage satchel which is of durable and reliable constructions.

An even further object of the present invention is to provide a new and improved Christmas tree transport and storage satchel which is susceptible of a low cost of manufacture with regard to both materials and labor, and which accordingly is then susceptible of low prices of sale to the consuming public, thereby making such Christmas tree transport and storage satchel economically available to the buying public.

Still yet another object of the present invention is to provide a new and improved Christmas tree transport and storage satchel which provides in the apparatuses and methods of the prior art some of the advantages thereof, while simultaneously overcoming some of the disadvantages normally associated therewith.

Still another object of the present invention is to place the apparatus around a Christmas tree to aid users in transporting and storing the tree.

Lastly, it is an object of the present invention to provide a new and improved a Christmas tree storage and transport satchel adapted for use in association with a Christmas tree, the apparatus comprising: a tarp formed in a generally elliptical configuration with two end edges and a rounded central region therebetween, the tarp having an inner surface and an outer surface, each end edge including a plurality of grommets extending therealong, the tarp having a first side edge and a second side edge each including coupling devices, the outer surface of the tarp including a hand strap affixed thereto, in an operative orientation the tarp being wrapped around a Christmas tree with the coupling devices of each side edge being coupled together, a drawstring being positioned through the grommets of each end edge to enable users to close the edges by tightening the drawstrings so that debris from the Christmas tree does not escape from the apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the Christmas tree transport and storage satchel constructed in accordance with the principles of the present invention.

FIG. 2 is a partially broken away perspective illustration of an uncoupled end of the apparatus with a Christmas tree positioned within it.

FIG. 5 is a perspective illustration of the apparatus in an open orientation and further illustrating the belt component thereof.

FIG. 6 is a perspective illustration of the shoulder strap of the apparatus taken along section line 6—6 of FIG. 5.

The same reference numerals refer to the same parts through the various Figures.

DESCRIPTION OF THE PREFERRED EMBODIMENT

Figure 3:
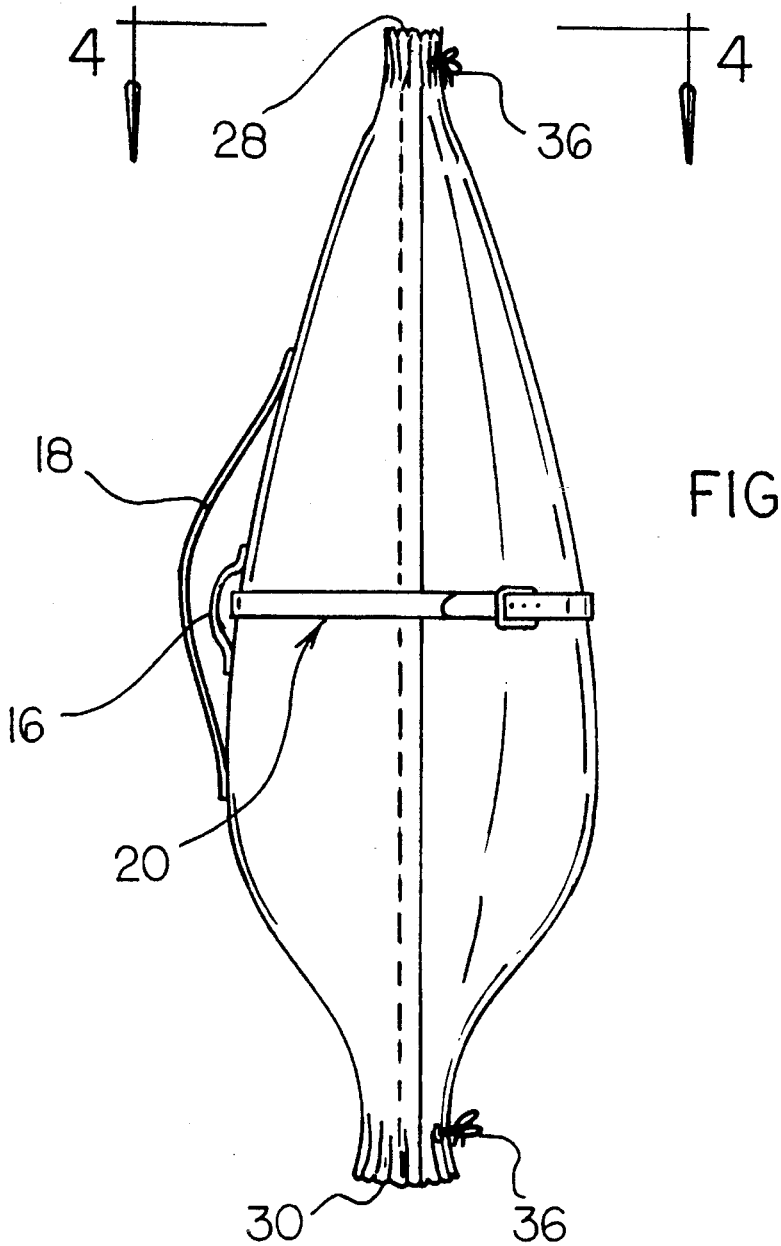
FIG. 3 is a perspective illustration of the apparatus positioned in a vertical orientation.
Figure 4:
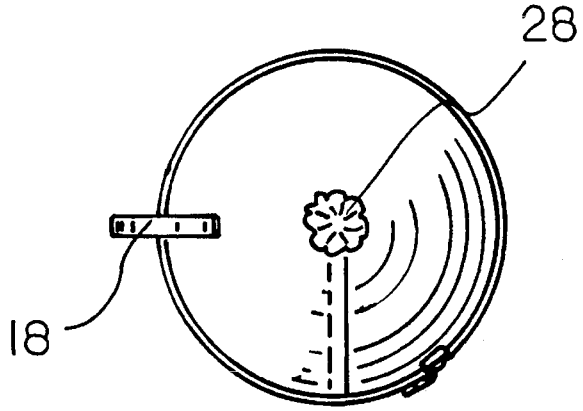
FIG. 4 is a top plan view of the apparatus taken along section line 4—4 of FIG. 3.

With reference now to the drawings, and in particular to FIG. 1 thereof, the preferred embodiment of the new and improved Christmas tree transport and storage satchel embodying the principles and concepts of the present invention and generally designated by the reference numeral 10 will be described.

The present invention, the Christmas tree transport and storage satchel 10 is comprised of a plurality of components. Such components in their broadest context include a Christmas tree 12, a tarp 14, a hand strap 16, a shoulder strap 18 and an adjustable belt 20. Such components are individually configured and correlated with respect to each other so as to attain the desired objective.

More specifically, the Christmas tree 12 is formed in a generally conical configuration and includes an upper extent with a point 24 and a lower extent with a stump 26. The apparatus is adapted to retain both artificial and natural Christmas trees. In the preferred embodiment a freshly cut natural Christmas tree is included with the apparatus. In alternative embodiments the Christmas tree transport and storage satchel is available without a tree. In such embodiments users may purchase Christmas trees from a nursery, tree lot or tree farm. The apparatus is particularly useful in transporting and storing natural Christmas trees since its construction prevents debris from soiling the transport or storage location. Note FIGS. 1 and 2.

A tarp 14 is fabricated of heavy duty nylon and is formed in a generally elliptical configuration with a first linear end edge 28, a second linear end edge 30, and a rounded central region 32 therebetween. In alternative embodiments of the apparatus the tarp is fabricated of a plurality of different natural and synthetic materials. Each linear end edge includes a plurality of grommets 34 extending therealong. A draw string 36 with two free ends is positioned through the grommets of each end edge to permit foldable closing of the end edges around the point and stump of a Christmas tree. Note FIGS. 1 and 3.

The tarp 14 has a first side edge 40 and a second side edge 42. Each side edge extends along the entire length of the tarp. Each side edge includes VELCRO coupling devices 46 and zipper teeth 48. A heavy duty zipper is utilized in the embodiment. The VELCRO coupling devices 46 are positioned directly upon each side edge. The zipper teeth are positioned interior to the VELCRO coupling devices 46 toward the centerpoint of the tarp. To utilize the apparatus the outer surface of the tarp is first laid upon the ground or a floor surface. A Christmas tree is then placed upon the approximate centerpoint of the tarp with its point 24 positioned adjacent to the first end edge and its stump 26 positioned adjacent to the second end edge. The side edges are then brought together around the tree. Note FIGS. 1, 2 and 5.

To secure the apparatus around a Christmas tree the zipper teeth of the side edges are coupled together by a slidable zipper coupler 50. The first side edge is coupled on top of the second side edge whereby the first side edge forms a VELCRO fastening flap to cover the zipper. The flap prevents potential injuries to users when manipulating the apparatus. The drawstrings positioned through the grommets of each end edge are then tightened and tied off to close the ends. The closed ends prevent debris such as tree needles and twigs from falling out of the apparatus. Note FIGS. 1–4.

The outer surface of the tarp includes a centrally positioned hand strap 16 affixed in an orientation perpendicular to the end edges. The hand strap is fabricated of sturdy flexible materials in the preferred embodiment. The hand strap permits users to easily manipulate and transport the apparatus by firmly grasping the hand strap. The hand strap is particularly useful when positioning the apparatus within a vehicle. A shoulder strap 18 is coupled adjacent to the hand strap in an orientation parallel to the hand strap. The shoulder strap is large enough to permit users to position an arm and shoulder through it. The shoulder strap provides users with the option of carrying the apparatus over their shoulders. The shoulder strap is particularly useful when carrying heavy trees over long distances. Note FIGS. 1, 3 and 6.

An adjustable belt 20 is formed in an elongated configuration with a first end 54 and a second end 56. The first end includes a buckle coupling device 58. The second end includes a plurality of holes 60 positioned along its length. After the apparatus has been enclosed around a Christmas tree, the belt is placed through the hand strap and around the entire circumference of the approximate center point of the apparatus. The plurality of holes in the second end of the belt enable users to adjust the belt to varying degrees of tightness around trees of varying diameters. Note FIGS. 1, 3 and 5.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved Christmas tree transport and storage satchel comprising, in combination:

a Christmas tree formed in a generally conical configuration and including an upper extent having a point and a lower extent having a stump;

a tarp fabricated of heavy duty nylon and formed in a generally elliptical configuration with two linear end edges and a rounded central region therebetween, the tarp having an inner surface and an outer surface, each linear end edge including a plurality of grommets extending therealong, the tarp having a first side edge and a second side edge, each side edge extending along the entire length of the tarp, each side edge including VELCRO coupling devices and zipper teeth, the first side edge adapted to be coupled on top of the second side edge whereby the first side edge forms a flap, the zipper teeth of the side edges adapted to be coupled together by a slidable zipper coupler, the outer surface of the tarp including a centrally positioned hand strap affixed thereto in an orientation perpendicular to the end edges, a shoulder strap being coupled adjacent to the hand strap in an orientation parallel to the hand strap, the shoulder strap being large enough to permit users to position an arm and shoulder therethrough, in an operative orientation the tarp being wrapped around a Christmas tree with the respective zipper teeth and VELCRO coupling devices being coupled together, a drawstring being positioned through the grommets of each end edge to enable users to close the ends by tightening the drawstrings so that debris from the Christmas tree does not escape from the apparatus; and an adjustable belt formed in an elongated configuration with a first end and a second end, the first end including a buckle coupling device, the second end including a plurality of holes positioned along its length, in an operative orientation the user adjusting the belt around the approximate centerpoint of the tarp to stabilize an enclosed Christmas tree.

* * * * *